US010035523B2

(12) United States Patent
Suzuki et al.

(10) Patent No.: US 10,035,523 B2
(45) Date of Patent: Jul. 31, 2018

(54) LEVELING VALVE

(71) Applicant: KYB Corporation, Tokyo (JP)

(72) Inventors: Tsutomu Suzuki, Kanagawa (JP); Yusuke Endo, Kanagawa (JP)

(73) Assignee: KYB Corporation, Tokyo (JP)

( * ) Notice: Subject to any disclaimer, the term of this patent is extended or adjusted under 35 U.S.C. 154(b) by 373 days.

(21) Appl. No.: 15/027,437

(22) PCT Filed: Nov. 26, 2013

(86) PCT No.: PCT/JP2013/081804
§ 371 (c)(1),
(2) Date: Apr. 6, 2016

(87) PCT Pub. No.: WO2015/079501
PCT Pub. Date: Jun. 4, 2015

(65) Prior Publication Data

US 2016/0251022 A1 Sep. 1, 2016

(51) Int. Cl.
*B61F 15/22* (2006.01)
*B61F 5/22* (2006.01)
*B61F 5/10* (2006.01)

(52) U.S. Cl.
CPC . *B61F 5/22* (2013.01); *B61F 5/10* (2013.01)

(58) Field of Classification Search
CPC ..... B61F 5/22; B61F 5/24
USPC ..... 105/164, 453
See application file for complete search history.

(56) References Cited

U.S. PATENT DOCUMENTS 3,573,884 A * 4/1971 Pollinger ..... B61F 5/22 105/164
3,941,061 A * 3/1976 Schindehutte ..... B60G 11/56 105/135
3,970,009 A * 7/1976 Schultz ..... B60G 17/0152 105/164
8,079,310 B2 * 12/2011 Popjoy ..... B61F 5/10 105/199.1
2015/0285388 A1 * 10/2015 Suzuki ..... F16K 11/168 137/223

FOREIGN PATENT DOCUMENTS

CA 2889454 A1 * 9/2014 ..... F16K 11/168
CA 2918866 A1 * 6/2015 ..... B61F 5/22
EP 2743152 A4 * 5/2015 ..... B61F 5/245
JP 61-105374 A 5/1986
JP 11-159632 A 6/1999
JP 2013-173438 A 9/2013
JP 2013-173439 A 9/2013

* cited by examiner

*Primary Examiner* — Zachary L Kuhfuss
(74) *Attorney, Agent, or Firm* — Rabin & Berdo, P.C.

(57) ABSTRACT

A leveling valve includes an actuator arm that rotates due to a restoring force of a buffer spring, and a connecting valve that is opened by the actuator arm against air pressure. The connecting valve includes a first valve body that is opened by being pressed by the actuator arm, a second valve body from/on which the first valve body is separated/seated, a sleeve from/on which the second valve body is separated/seated, and an engaging portion that is provided to the second valve body and engages with the first valve body when the first valve body has moved by a predetermined distance after the first valve body is opened. A pressure receiving area of the second valve body is larger than a pressure receiving area of the first valve body.

4 Claims, 7 Drawing Sheets

LEVELING VALVE

TECHNICAL FIELD

The present invention relates to a leveling valve.

BACKGROUND ART

JP 2013-173438A discloses a leveling valve that adjusts the height of an air spring used in a railway vehicle. The leveling valve maintains a vehicle body at a certain height by selectively connecting the air spring to a compressor or an air discharge passage, depending on the rotational direction of a lever that rotates in accordance with a relative displacement of the vehicle body with respect to a truck.

The leveling valve includes an air supply valve that switches communication between the air spring and the compressor, an air discharge valve that switches communication between the air spring and the air discharge passage, and an actuator arm to which rotation of the lever is transmitted via a buffer spring.

Each of the air supply valve and the air discharge valve includes a cylindrical sleeve and a valve body that is arranged slidably inside the sleeve. The valve body of the air supply valve is pushed in a valve-closing direction by air pressure of the compressor, whereas the valve body of the air discharge valve is pushed in a valve-closing direction by air pressure of the air spring. The actuator arm rotates due to a restoring force of the buffer spring that deforms in accordance with rotation of the lever, and presses the valve body of the air supply valve or the air discharge valve. In this way, the air supply valve or the air discharge valve is opened.

SUMMARY OF INVENTION

According to the conventional leveling valve described above, if flow passage areas are increased for the purpose of increasing the flow rates of the air supply valve and the air discharge valve, pressure receiving areas of the valve bodies are increased. This makes it necessary to increase a pressing force of the actuator arm for pushing the valve bodies in a valve-opening direction against air pressure. As the actuator arm rotates due to the restoring force of the buffer spring that deforms in accordance with rotation of the lever, the buffer spring needs to be increased in size as well. This results in an increase in the size of a valve case that houses the buffer spring, hence an increase in the dimensions of the leveling valve.

It is an object of the present invention to provide a leveling valve that allows for an increase in a flow passage area without increasing the size of a buffer spring.

According to one aspect of the present invention, a leveling valve configured to adjust a height of an air spring provided between a vehicle body and a truck of a railway vehicle includes a lever configured to rotate in accordance with a relative displacement of the vehicle body with respect to the truck; an actuator arm configured to rotate due to a restoring force of a buffer spring that deforms in accordance with rotation of the lever; and a connecting valve configured to be opened by rotation of the actuator arm against air pressure, and connect a compressed air source or an air discharge passage to an air spring passage communicating with the air spring. The connecting valve includes a first valve body configured to move in a valve-opening direction by being pressed by the actuator arm in accordance with rotation of the actuator arm; a second valve body configured to include a first valve seat from/on which the first valve body is separated/seated; a sleeve inside which the first valve body and the second valve body are slidably arranged, the sleeve including an annular second valve seat from/on which the second valve body is separated/seated; and an engaging portion provided to the second valve body, the engaging portion being configured to engage with the first valve body and move the second valve body in the valve-opening direction together with the first valve body when the first valve body has moved by a predetermined distance after the first valve body is opened. A pressure receiving area of the second valve body is larger than a pressure receiving area of the first valve body.

DESCRIPTION OF EMBODIMENTS

Hereinafter, embodiments of the present invention are described with reference to the accompanying drawings.

Figure 1:
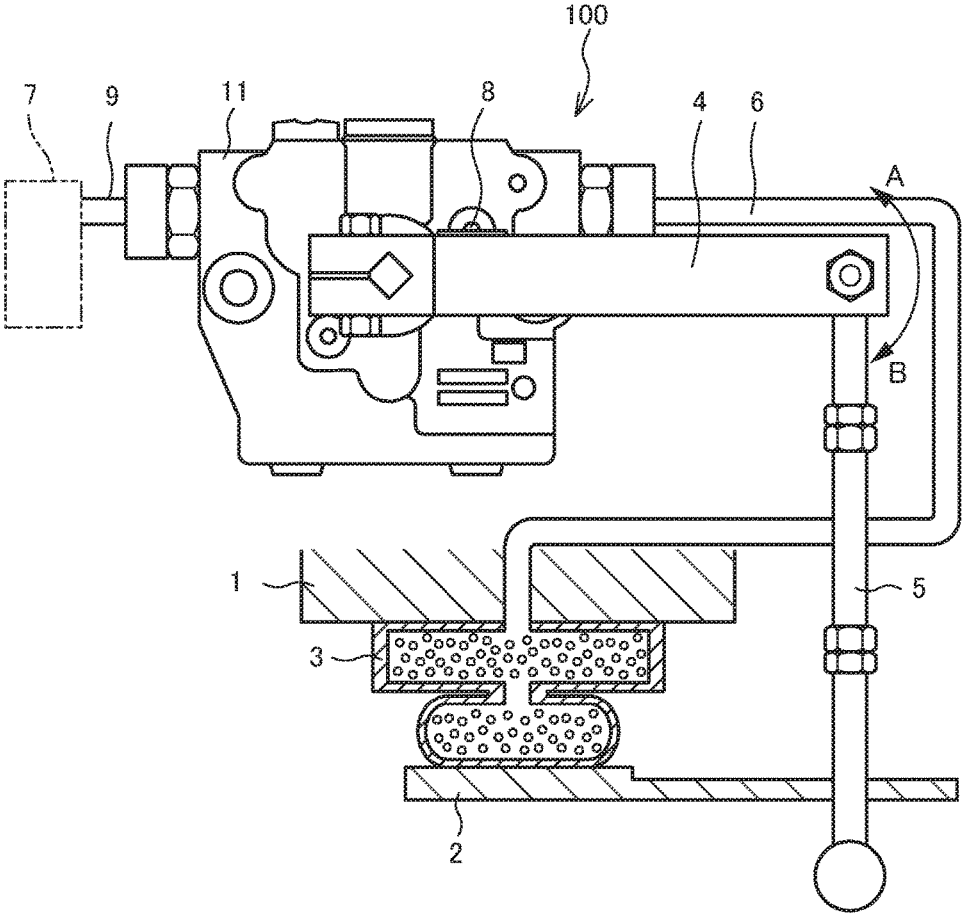
FIG. 1 shows a leveling valve in a mounted state according to an embodiment of the present invention.

FIG. 1 shows a leveling valve 100 in a mounted state according to the present embodiment.

The leveling valve 100 has a function of adjusting the height of an air spring 3 provided between a vehicle body 1 and a truck 2 of a railway vehicle so as to maintain the vehicle body 1 at a certain height.

The leveling valve 100 is installed to extend across the vehicle body 1 and the truck 2. Specifically, the leveling valve 100 is mounted on the vehicle body 1, and is coupled to the truck 2 via a lever 4 and a coupling rod 5. When the height of the vehicle body 1 changes due to expansion and compression of the air spring 3 caused by a change in the load on the vehicle body 1, this change is transmitted to the leveling valve 100 via the coupling rod 5 and the lever 4.

When the air spring 3 is compressed due to an increase in the load on the vehicle body, the lever 4 is pushed upward from a neutral position (rotation in the direction of arrow A in FIG. 1). Consequently, an air supply valve 31 (see FIG. 2) of the leveling valve 100 is opened, and an air spring passage 6 communicating with the air spring 3 communicates with a compressor 7 serving as a compressed air source. In this way, compressed air from the compressor 7 is supplied to the air spring 3. Once the air spring 3 reverts to a certain height, the lever 4 returns to the neutral position, the air supply valve 31 of the leveling valve 100 is closed, and the supply of the compressed air is blocked.

On the other hand, when the air spring 3 has expanded due to a decrease in the load on the vehicle body, the lever 4 is pulled downward from the neutral position (rotation in the direction of arrow B in FIG. 1). Consequently, an air discharge valve 32 (see FIG. 2) of the leveling valve 100 is opened, and the air spring passage 6 communicates with an air discharge passage 8. As the air discharge passage 8 communicates with the atmosphere, compressed air in the air spring 3 is discharged to the atmosphere. Once the air spring 3 reverts to a certain height, the lever 4 returns to the neutral position, the air discharge valve 32 of the leveling valve 100 is closed, and the discharge of the compressed air is blocked.

In this way, the leveling valve 100 causes the air spring 3 to selectively communicate with the compressor 7 or the air discharge passage 8, depending on the rotational direction of the lever 4 that rotates in accordance with a relative displacement of the vehicle body 1 with respect to the truck 2. As a result, the relative displacement between the vehicle body 1 and the truck 2 is automatically adjusted, and the vehicle body 1 is maintained at a certain height.

Figure 2:
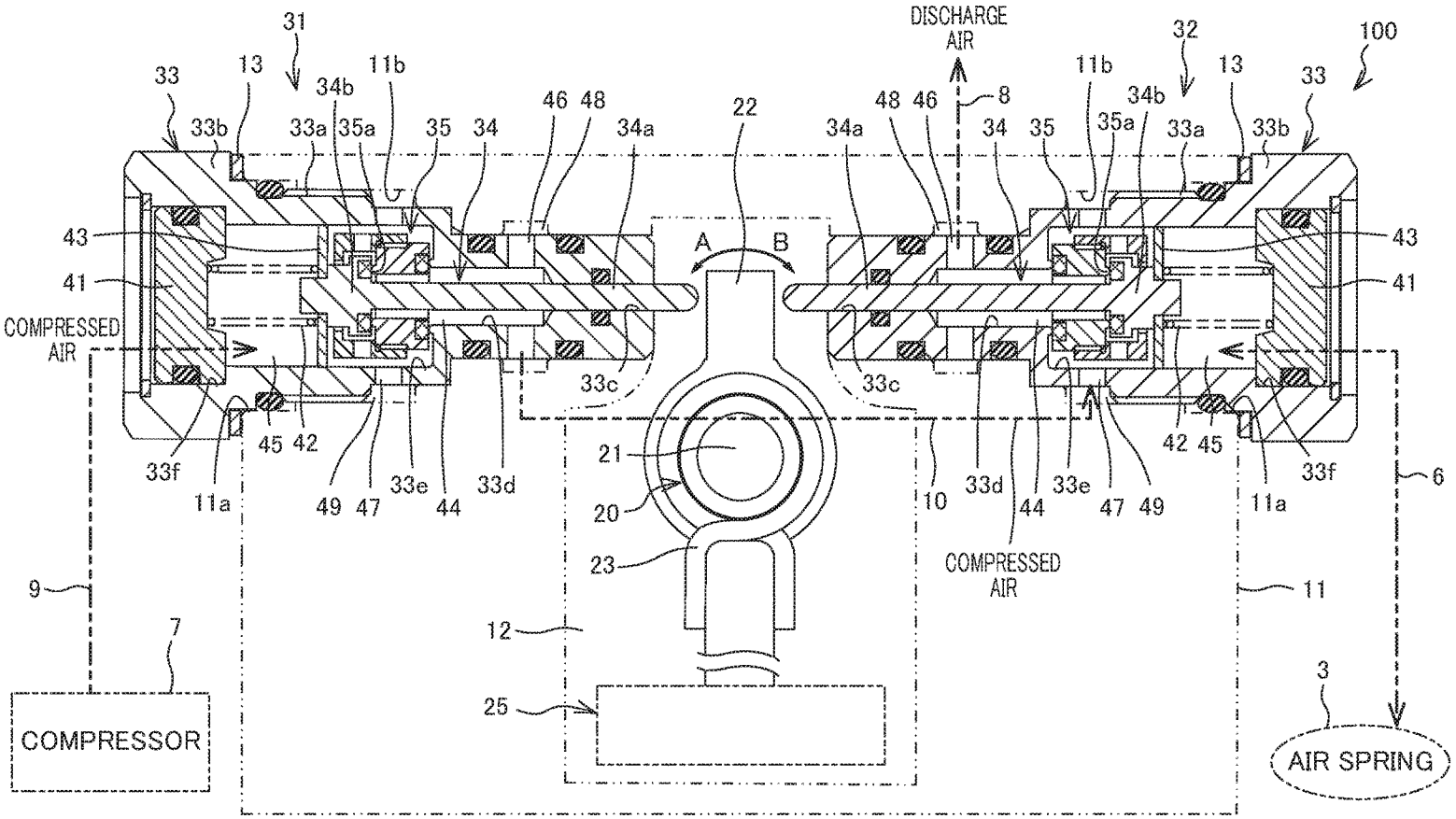
FIG. 2 is a cross-sectional view of the leveling valve according to the embodiment of the present invention.
Figure 3:
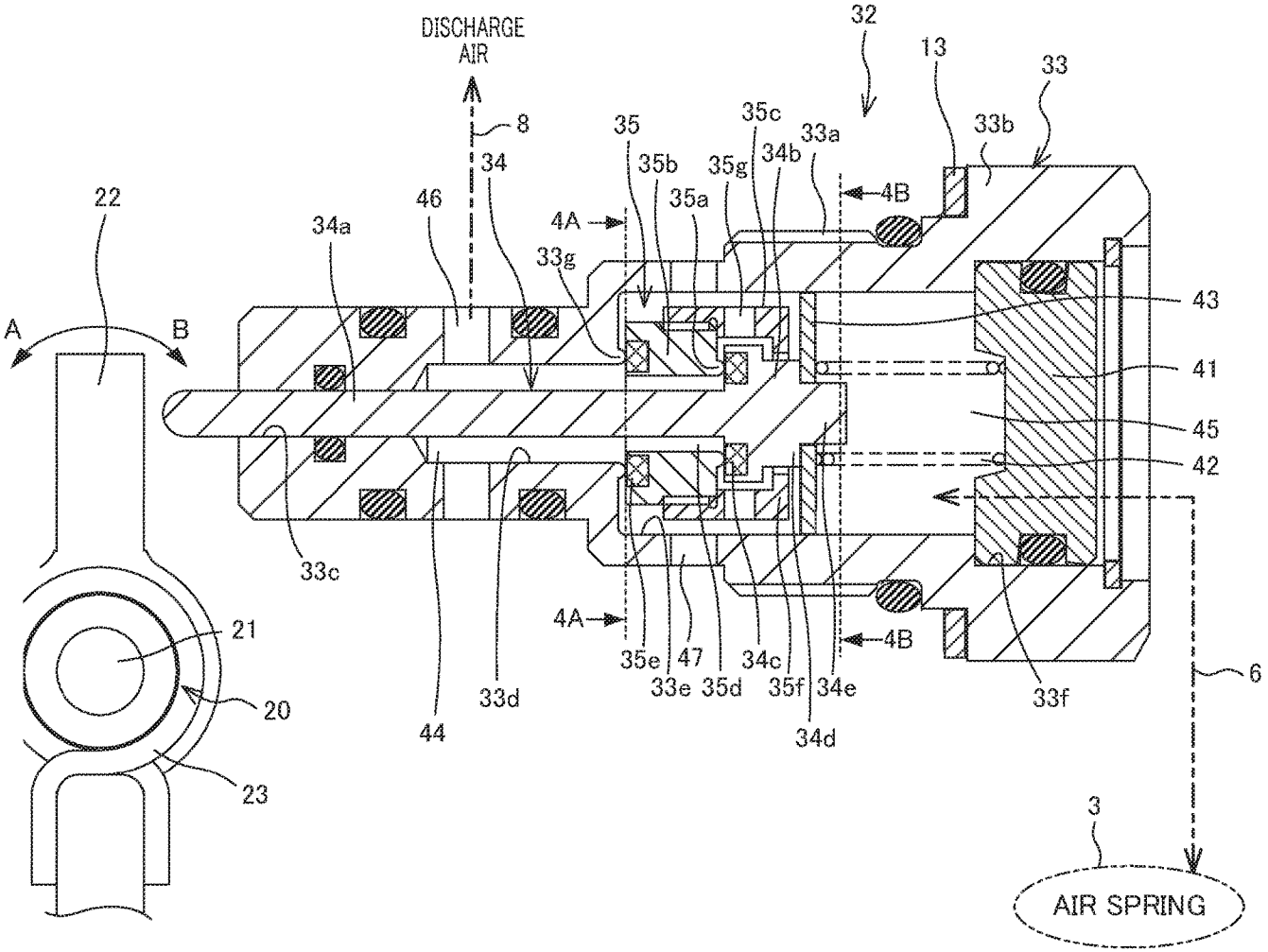
FIG. 3 is an enlarged view of an air discharge valve.
Figure 4A:
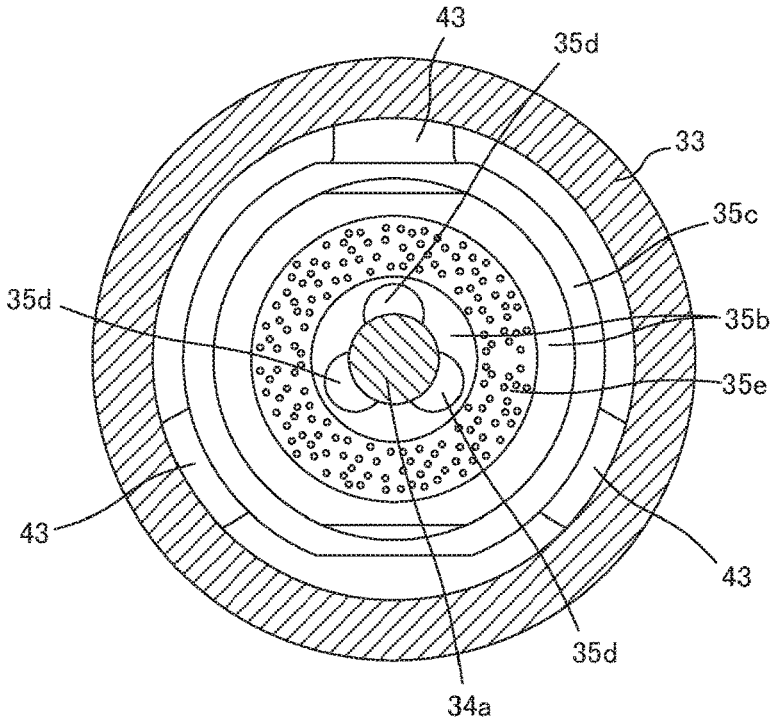
FIG. 4A is a cross-sectional view showing a cross section taken along the line 4A-4A of FIG. 3.
Figure 4B:
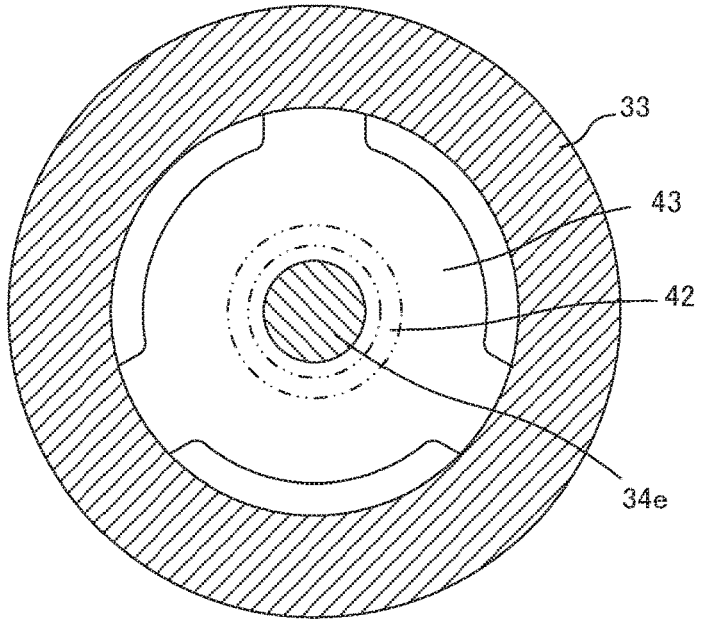
FIG. 4B is a cross-sectional view showing a cross section taken along the line 4B-4B of FIG. 3.

FIG. 2 is a cross-sectional view of the leveling valve 100 according to the present embodiment. FIG. 3 is an enlarged view of the air discharge valve 32. FIG. 4A is a cross-sectional view showing a cross section taken along the line 4A-4A of FIG. 3. FIG. 4B is a cross-sectional view showing a cross section taken along the line 4B-4B of FIG. 3.

The leveling valve 100 includes a buffer spring unit 20 arranged in a central region, the air supply valve 31 and the air discharge valve 32 arranged in an upper region as connecting valves, and an oil damper 25 arranged in a lower region.

The buffer spring unit 20 includes a swing arm (not shown), an actuator arm 22, and a buffer spring 23. The swing arm is fixed to a shaft 21 to which the lever 4 is coupled. The actuator arm 22 rotates freely with respect to the shaft 21. The buffer spring 23 is installed with an initial load applied thereto in such a manner that the buffer spring 23 is concentric with the shaft 21. The buffer spring 23 is arranged in contact with the swing arm and the actuator arm 22 at the same time. Rotation of the lever 4 is transmitted to the actuator arm 22 via the swing arm and the buffer spring 23. That is to say, the actuator arm 22 rotates due to a restoring force of the buffer spring 23 that deforms in accordance with rotation of the lever 4.

The oil damper 25 includes a piston (omitted from the drawings) that is coupled to a proximal end side of the actuator arm 22 and moves in accordance with rotation of the actuator arm 22. The piston is arranged such that it is immersed in an oil chamber 12 formed inside a valve case 11. While the piston applies resistance to a rotational operation of the actuator arm 22 when the actuator arm 22 rotates from a neutral position, the piston hardly applies resistance to the actuator arm 22 when the actuator arm 22 returns to the neutral position.

The air supply valve 31 and the air discharge valve 32 will now be described. As the air supply valve 31 and the air discharge valve 32 have the same configuration, the following description centers mainly on the air discharge valve 32. It should be noted that the same components of the air supply valve 31 and the air discharge valve 32 are given the same reference signs.

The air supply valve 31 and the air discharge valve 32 are arranged symmetrically with respect to a distal end side of the actuator arm 22, and are housed inside the valve case 11. A pair of valve housing holes 11*a* is formed in the valve case 11. Each of the valve housing holes 11*a* opens to the outer surface of the valve case 11 at one end, and opens to the oil chamber 12 at the other end. The air supply valve 31 and the air discharge valve 32 are respectively housed in the valve housing holes 11*a*.

The air discharge valve 32 includes a substantially cylindrical sleeve 33, a first valve body 34, and a second valve body 35. The sleeve 33 is fastened inside the valve housing hole 11*a*. The first valve body 34 is arranged slidably inside the sleeve 33 and moves in accordance with rotation of the actuator arm 22. The second valve body 35 is arranged slidably inside the sleeve 33, is provided annularly around the outer circumference of the first valve body 34, and includes a first valve seat 35*a* from/on which the first valve body 34 is separated/seated.

A male thread portion 33*a* is formed on a part of the outer circumferential surface of the sleeve 33. The sleeve 33 is fastened inside the valve housing hole 11*a* by having this male thread portion 33*a* threaded into a female thread portion 11*b* formed on the inner circumference of the valve housing hole 11*a*. A flange portion 33*b* extending radially is formed on the outer circumference of the sleeve 33. The position of the sleeve 33 inside the valve housing hole 11*a* is set by this flange portion 33*b* coming into contact with the outer peripheral surface of the valve case 11 via a washer 13.

At the axial center of the sleeve 33, a first bore 33*c*, a second bore 33*d*, a third bore 33*e*, and a fourth bore 33*f* are formed serially in this order, from the oil chamber 12 side, in such a manner that they communicate with one another. The diameters of the first bore 33*c*, the second bore 33*d*, the third bore 33*e*, and the fourth bore 33*f* increase in this order.

A second valve seat 33*g* is formed in a boundary step portion between the second bore 33*d* and the third bore 33*e*. The second valve body 35 is seated on or separated from the second valve seat 33*g*. The second valve seat 33*g* is raised from the sleeve 33 in a valve-opening direction (a rightward direction in FIG. 3). A gap is formed between a portion of the sleeve 33 other than the second valve seat 33*g* and the second valve body 35.

The first valve body 34 includes a sliding portion 34*a* and a valve body portion 34*b*. The sliding portion 34*a* slides along the first bore 33*c* of the sleeve 33. The valve body portion 34*b* has a larger diameter than the sliding portion 34*a*, and opens and closes the first valve seat 35*a*. In a boundary step portion between the sliding portion 34*a* and the valve body portion 34*b*, a seat portion 34*c* is formed flat in a radial direction of the first valve body 34. The seat portion 34*c* blocks the flow of compressed air when it is seated on the first valve seat 35*a*, and permits the flow of compressed air when it is separated from the first valve seat 35*a*. A first reduced-diameter portion 34*d* and a second reduced-diameter portion 34*e* are formed, in this order, on a side of the valve body portion 34*b* opposite from the sliding portion 34*a*. The first reduced-diameter portion 34*d* has a smaller outer diameter than the valve body portion 34*b*, and the second reduced-diameter portion 34*e* has a smaller outer diameter than the first reduced-diameter portion 34*d*.

The second valve body 35 includes a valve body portion 35*b* and an annular extending portion 35*c*. The valve body portion 35*b* is provided annularly around the outer circumference of the sliding portion 34*a* of the first valve body 34. The extending portion 35*c* is coupled to the valve body portion 35*b*, extends in the valve-opening direction, and is provided around the outer circumference of the valve body portion 34*b* of the first valve body 34.

As shown in FIG. 4A, the inner circumference of the valve body portion 35*b* slides on the outer circumference of the sliding portion 34*a* of the first valve body 34, and the outer circumference of the valve body portion 35*b* threaded into the inner circumference of the extending portion 35*c* (FIG. 3). A cutaway connection passage 35*d* is formed on the inner circumference of the valve body portion 35*b* along the sliding portion 34*a* of the first valve body 34. The connection passage 35*d* is provided in three areas in a circumferential direction of the valve body portion 35*b*, and extends from an end portion of the valve body portion 35*b* in the valve-opening direction to an end portion of the valve body portion 35*b* in a valve-closing direction (FIG. 3).

The first valve seat 35*a* is formed on the end portion of the valve body portion 35*b* in the valve-opening direction. The valve body portion 34*b* of the first valve body 34 is separated from and seated on the first valve seat 35*a*. On the end portion of the valve body portion 35*b* in the valve-closing direction, a seat portion 35*e* is formed flat in a radial direction of the second valve body 35. The seat portion 35*e* blocks the flow of compressed air when seated on the second valve seat 33*g* raised from the sleeve 33, and permits the flow of compressed air when separated from the second valve seat 33*g*.

The extending portion 35*c* is formed such that a predetermined space is present between the inner circumference thereof and the valve body portion 34*b* of the first valve body 34, and a predetermined space is present between the outer circumference thereof and the third bore 33*e*. An engaging portion 35*f* with a reduced inner diameter is provided at a tip of the extending portion 35*c*. The extending portion 35*c* and the engaging portion 35*f* constitute a part of the second valve body.

The inner diameter of the engaging portion 35*f* is smaller than the outer diameter of the valve body portion 34*b* of the first valve body 34, and is larger than the outer diameter of the first reduced-diameter portion 34*d*. Furthermore, when the first valve body 34 is seated on the first valve seat 35*a*, the engaging portion 35*f* is separated from the valve body portion 34*b* of the first valve body 34 by a predetermined distance in an axial direction (a left-right direction in FIG. 3). In this way, when the first valve body 34 has moved in the valve-opening direction by the predetermined distance after it is opened, the first valve body 34 and the second valve body 35 engage with each other and move integrally in the valve-opening direction.

A through-hole 35*g* that radially penetrates the extending portion 35*c* is formed in the extending portion 35*c*. After the first valve body 34 is opened, the through-hole 35*g* serving as a connection passage makes the inner circumferential side and the outer circumferential side of the extending portion 35*c* communicate with each other, thus creating a passage that allows the air to flow therethrough.

A closing member 41 provided with a through-passage (not shown) at the axial center is pressed into the fourth bore 33*f* of the sleeve 33. The closing member 41 closes an air chamber inside the sleeve 33 by contacting closely with a boundary step portion between the third bore 33*e* and the fourth bore 33*f*. The through-passage of the closing member 41 of the air supply valve 31 is connected to a communication passage 9 that communicates with the compressor 7, whereas the through-passage of the closing member 41 of the air discharge valve 32 is connected to the air spring passage 6. In the case where the closing member 41 cannot be provided with the through-passage, the communication passage 9 connected to the compressor 7 may be connected to a high-pressure port 47 of the air supply valve 31, and the air spring passage 6 may be connected to a high-pressure port 47 of the air discharge valve 32.

A coil spring 42 is provided in a compressed state between the closing member 41 and the valve body portion 34*b* of the first valve body 34. The coil spring 42 pushes the first valve body 34 in the valve-closing direction. The coil spring 42 pushes the first valve body 34 via a spring catch member 43 that is fixedly fit to the outer circumference of the second reduced-diameter portion 34*e* formed on the valve body portion 34*b* of the first valve body 34.

As shown in FIG. 4B, the inner circumference of the spring catch member 43 contacts tightly with the second reduced-diameter portion 34*e* of the first valve body 34, and the outer circumference of the spring catch member 43 slides on the inner wall of the third bore 33*e* in three areas in a circumferential direction. A gap is present between the inner wall of the third bore 33*e* and portions of the outer circumference of the spring catch member 43 other than the portions that slide on the third bore 33*e*. The air passes through this gap in accordance with sliding of the first valve body 34.

In this way, the spring catch member 43 is pressed against and fixed to the first valve body 34 and slides on the inner wall of the third bore 33*e*, and the second valve body 35 slides on the outer circumference of the sliding portion 34*a* of the first valve body 34. Thus, the first valve body 34 and the second valve body 35 are slidable in the axial direction, and their radial movement is restricted.

A part of the sliding portion 34*a* of the first valve body 34 projects inside the oil chamber 12. When the seat portion 34*c* is seated on the first valve seat 35*a*, a tip portion of the sliding portion 34*a* faces the actuator arm 22 via a predetermined gap therebetween. When the actuator arm 22 has rotated from the neutral position by a predetermined degree or more, the actuator arm 22 comes into contact with the tip portion of the sliding portion 34*a*. In accordance with rotation of the actuator arm 22, the first valve body 34 moves against a pushing force of the coil spring 42, and the seat portion 34*c* is separated from the first valve seat 35*a*. Consequently, the first valve body 34 is opened. When the first valve body 34 has moved in the valve-opening direction by the predetermined distance after it is opened, the second valve body 35 engages with the first valve body 34 via the engaging portion 35*f*, and moves together with the first valve body 34, thereby separating the seat portion 35*e* from the second valve seat 33*g*. Consequently, the second valve body 35 is opened.

In this way, according to the leveling valve 100, in order to provide a dead zone where the supply/discharge of compressed air to /from the air spring 3 is prohibited, a predetermined gap is present between the actuator arm 22 and the air supply valve 31, as well as between the actuator arm 22 and the air discharge valve 32, such that the air supply valve 31 and the air discharge valve 32 are not opened immediately after the actuator arm 22 rotates from the neutral position. This makes it possible to prohibit the supply/discharge of compressed air to/from the air spring 3 when the actuator arm 22 has rotated by a degree smaller than the predetermined degree, and thus to prevent hunting of the air supply valve 31 and the air discharge valve 32. The dead zone of the air supply valve 31 and the air discharge valve 32 is set by adjusting the thickness or the number of the washer(s) 13.

A first air chamber 44 and a second air chamber 45 are provided inside the sleeve 33. The first air chamber 44 always communicates with the air discharge passage 8. The second air chamber 45 is separated from the first air chamber 44 by the first valve body 34 and the second valve body 35, and always communicates with the air spring 3 via the air spring passage 6. It should be noted that the second air chamber 45 of the air supply valve 31 always communicates with the compressor 7 via the communication passage 9.

As the second valve body 35 is provided around the outer circumference of the sliding portion 34*a* of the first valve body 34, a pressure receiving area of the second valve body 35 is larger than a pressure receiving area of the first valve body 34. Therefore, when the first valve body 34 and the second valve body 35 are both closed, a force applied to the second valve body 35 in the valve-closing direction due to a differential pressure between the first air chamber 44 and the second air chamber 45 is larger than a force applied to the first valve body 34 in the valve-closing direction due to the differential pressure between the first air chamber 44 and the second air chamber 45.

A low-pressure port 46 and a high-pressure port 47 are formed in the sleeve 33. The low-pressure port 46 and the high-pressure port 47 communicate with the first air chamber 44 and the second air chamber 45, respectively, and penetrate the inner and outer circumferential surfaces of the sleeve 33. The low-pressure port 46 always communicates with a first annular passage 48 formed in the valve case 11. The high-pressure port 47 always communicates with a second annular passage 49 formed in the valve case 11.

The first annular passage 48 for the air supply valve 31 and the second annular passage 49 for the air discharge valve 32 communicate with each other via a link passage 10 formed in the valve case 11. That is to say, the low-pressure port 46 of the air supply valve 31 and the high-pressure port 47 of the air discharge valve 32 communicate with each other via the link passage 10. At a point in this link passage 10, a check valve (not shown) is provided that permits only the flow of compressed air from the low-pressure port 46 of the air supply valve 31 to the high-pressure port 47 of the air discharge valve 32. The low-pressure port 46 of the air discharge valve 32 communicates with the air discharge passage 8 via the first annular passage 48.

An operation of the leveling valve 100 will now be described.

When the air spring 3 has expanded due to a decrease in the load on the vehicle body, the lever 4 is pushed downward from the neutral position in accordance with a relative displacement of the vehicle body 1 with respect to the truck 2 (FIG. 1). Consequently, the buffer spring 23 deforms. The restoring force of this buffer spring 23 is transmitted to the actuator arm 22, and the actuator arm 22 rotates from the neutral position in the direction of arrow B in FIG. 3.

When the actuator arm 22 has rotated by the predetermined degree or more, the actuator arm 22 presses the first valve body 34 of the air discharge valve 32. At this time, the first valve body 34 is opened by moving against the pushing force of the coil spring 42 and a force calculated by multiplying the differential pressure between the first air chamber 44 and the second air chamber 45 by a pressure receiving area to which this differential pressure is applied. In this case, only the first valve body 34 is opened, and therefore the foregoing pressure receiving area denotes only a pressure receiving area of the first valve body 34, and does not include a pressure receiving area of the second valve body 35.

Figure 5:
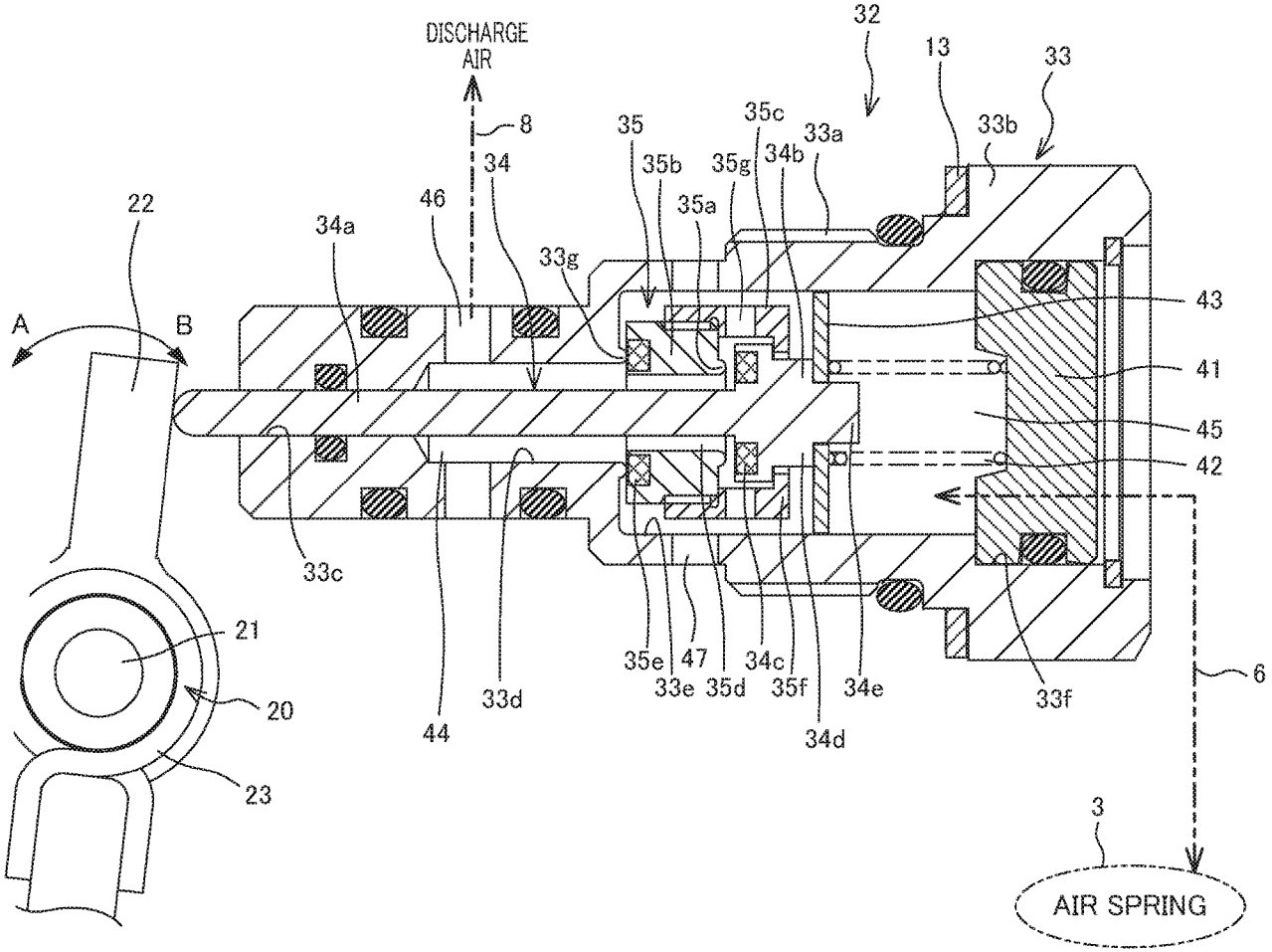
FIG. 5 is a cross-sectional view showing a state in which a first valve body of the air discharge valve is open.

As shown in FIG. 5, once the first valve body 34 is opened, the first air chamber 44 and the second air chamber 45 of the air discharge valve 32 communicate with each other via the connection passage 35*d* of the second valve body 35 and the through-hole 35*g* of the extending portion 35*c*. Furthermore, when the first valve body 34 has moved in the valve-opening direction by the predetermined distance after it is opened, the engaging portion 35*f* engages with the first valve body 34.

At this time, as the first air chamber 44 and the second air chamber 45 communicate with each other, the differential pressure between the first air chamber 44 and the second air chamber 45 decreases. Moreover, as a gap is formed between an end portion side of the second valve body 35 in the valve-closing direction and the sleeve 33, a force attributed to the differential pressure between the first air chamber 44 and the second air chamber 45 hardly acts on the second valve body 35.

Figure 6:
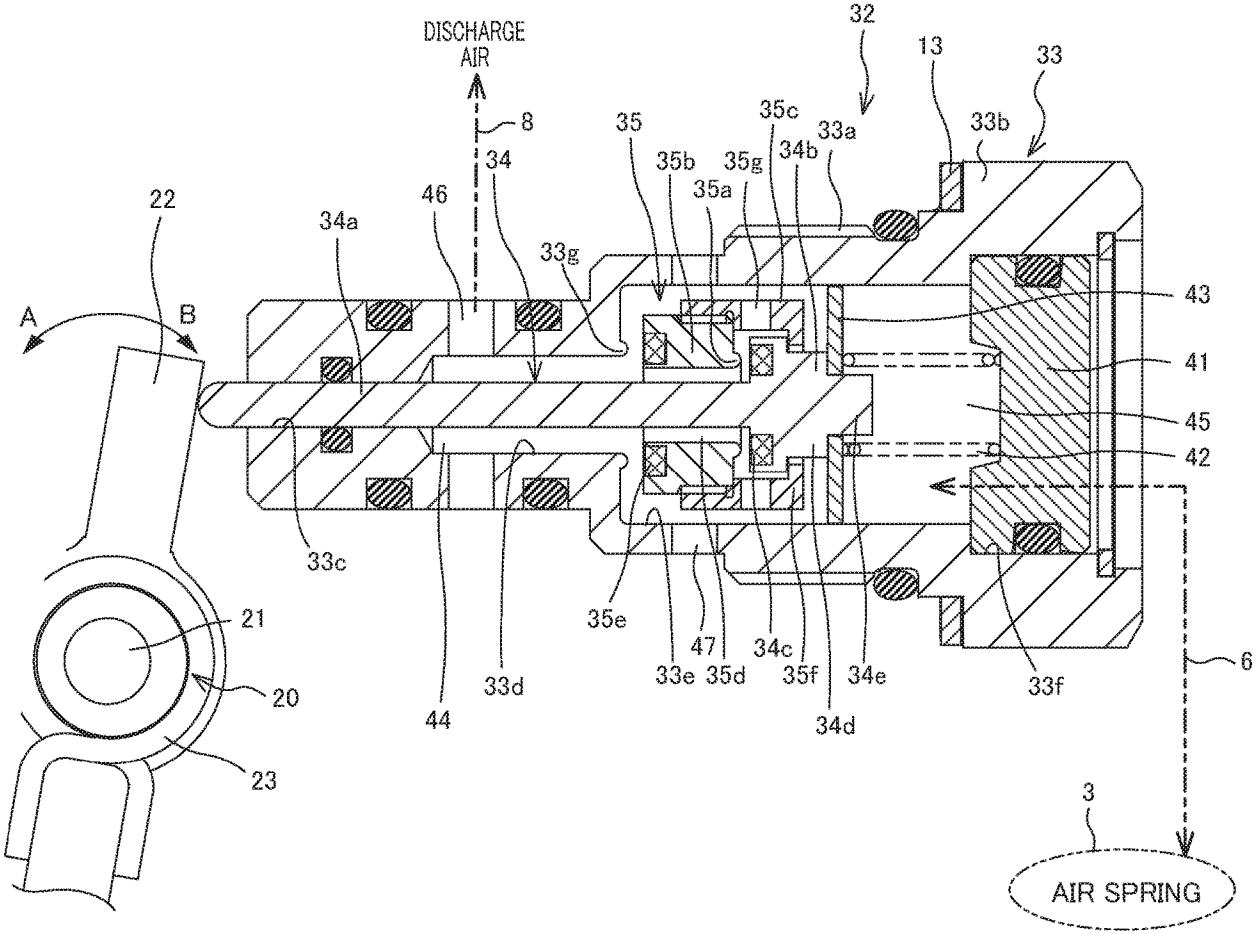
FIG. 6 is a cross-sectional view showing a state in which a second valve body of the air discharge valve is open.

As shown in FIG. 6, when the first valve body 34 moves farther in the valve-opening direction, the second valve body 35 moves in the valve-opening direction together with the first valve body 34. As a result, the first air chamber 44 and the second air chamber 45 communicate with each other via a gap between the second valve body 35 and the sleeve 33.

At this time, the first valve body 34 moves the second valve body 35 via the engaging portion 35*f*. As stated earlier, the force attributed to the differential pressure between the first air chamber 44 and the second air chamber 45 hardly acts on the second valve body 35, and hence there is hardly any increase in a pressing force required for the actuator arm 22 to open the second valve body 35. That is to say, a force that is applied to the second valve body 35 in the valve-closing direction due to the differential pressure between the first air chamber 44 and the second air chamber 45 when the first valve body 34 and the second valve body 35 are both closed is cancelled upon opening of the first valve body 34.

In this way, compressed air in the air spring 3 is discharged to the atmosphere via the second air chamber 45, the first air chamber 44, and the low-pressure port 46 of the air discharge valve 32, and via the air discharge passage 8. Although the high-pressure port 47 of the air discharge valve 32 communicates with the low-pressure port 46 of the air supply valve 31 via the link passage 10, the check valve provided to the link passage 10 prevents compressed air in the air spring 3 from flowing toward the air supply valve 31.

On the other hand, when the air spring 3 is compressed due to an increase in the load on the vehicle body, the lever 4 is pushed upward from the neutral position in accordance with a relative displacement of the vehicle body 1 with respect to the truck 2 (FIG. 1). Consequently, the buffer spring 23 deforms. The restoring force of this buffer spring 23 is transmitted to the actuator arm 22, and the actuator arm 22 rotates from the neutral position in the direction of arrow A in FIG. 3.

When the actuator arm 22 has rotated by the predetermined degree or more, the actuator arm 22 presses the first valve body 34 of the air discharge valve 32. At this time, the first valve body 34 is opened by moving against the pushing force of the coil spring 42 and a force calculated by multiplying the differential pressure between the first air chamber 44 and the second air chamber 45 by a pressure receiving area to which this differential pressure is applied. In this case, only the first valve body 34 is opened, and therefore the foregoing pressure receiving area denotes only a pressure receiving area of the first valve body 34, and does not include a pressure receiving area of the second valve body 35.

Once the first valve body 34 is opened, the first air chamber 44 and the second air chamber 45 of the air supply valve 31 communicate with each other via the connection passage 35*d* of the second valve body 35 and the through-hole 35*g* of the extending portion 35*c*. Furthermore, when the first valve body 34 has moved in a valve-opening direction by the predetermined distance after it is opened, the engaging portion 35*f* engages with the first valve body 34.

At this time, as the first air chamber 44 and the second air chamber 45 communicate with each other, the differential pressure between the first air chamber 44 and the second air chamber 45 decreases. Moreover, as a gap is formed between an end portion side of the second valve body 35 in a valve-closing direction and the sleeve 33, a force attributed to the differential pressure between the first air chamber 44 and the second air chamber 45 hardly acts on the second valve body 35.

When the first valve body 34 moves farther in the valve-opening direction, the second valve body 35 moves in the valve-opening direction together with the first valve body 34. As a result, the first air chamber 44 and the second air chamber 45 communicate with each other via a gap between the second valve body 35 and the sleeve 33.

At this time, the first valve body 34 moves the second valve body 35 via the engaging portion 35*f*. As stated earlier, the force attributed to the differential pressure between the first air chamber 44 and the second air chamber 45 hardly acts on the second valve body 35, and hence there is hardly any increase in a pressing force required for the actuator arm 22 to open the second valve body 35. That is to say, a force that is applied to the second valve body 35 in the valve-closing direction due to the differential pressure between the first air chamber 44 and the second air chamber 45 when the first valve body 34 and the second valve body 35 are both closed is cancelled upon opening of the first valve body 34.

In this way, compressed air in the compressor 7 flows through the second air chamber 45, the first air chamber 44, and the low-pressure port 46 of the air supply valve 31, pushes open the check valve of the link passage 10, and is supplied to the air spring 3 via the high-pressure port 47 and the second air chamber 45 of the air discharge valve 32.

Once the air spring 3 reverts to a certain height as a result of the supply of compressed air in the compressor 7 to the air spring 3 via the air supply valve 31, the lever 4 returns to the neutral position, and the actuator arm 22 returns to the neutral position as well. Consequently, the first valve body 34 and the second valve body 35 of the air supply valve 31 are seated on the first valve seat 35*a* and the second valve seat 33*g*, respectively, due to the pushing force of the coil spring 42. Therefore, the air supply valve 31 is closed, and the supply of compressed air is blocked.

The above-described embodiment achieves the following effects.

Once the first valve body 34 is opened in accordance with rotation of the actuator arm 22, the air flows via the through-hole 35*g* and the connection passage 35*d*. Accordingly, the differential pressure between the first air chamber 44 and the second air chamber 45 decreases, and the second valve body 35 is opened together with the first valve body 34 via the engaging portion 35*f*. In this way, the actuator arm 22 can also open the second valve body 35, which has a larger pressure receiving area than the first valve body 34, simply by applying a force of pressing the first valve body 34 in the valve-opening direction. Therefore, a larger flow passage area can be secured without increasing the size of the buffer spring 23 that applies a rotational force to the actuator arm 22.

Furthermore, the second valve seat 33*g* is raised from the sleeve 33 in the valve-opening direction, and a flow passage is present between the inner circumference of the sleeve and the outer circumference of the second valve body 35. In this way, air pressure can be directed via this flow passage to the gap between the end portion side of the second valve body 35 in the valve-closing direction and the second valve seat 33*g* formed in the sleeve 33. With this air pressure, the second valve body 35 is always pushed in the valve-opening direction. Consequently, when the first valve body 34 moves in the valve-opening direction together with the second valve body 35 via the engaging portion 35*f* after the first valve body 34 is opened in accordance with rotation of the actuator arm 22, an increase in a pressing force required for the actuator arm 22 can be suppressed. Therefore, the second valve body 35 can be opened more reliably. This makes it possible to secure a large flow passage area without increasing the size of the buffer spring 23.

Moreover, formation of the through-hole 35*g* in the extending portion 35*c* allows for an increase in a flow passage area of a passage via which the first air chamber 44 and the second air chamber 45 communicate with each other when the first valve body 34 is opened. In this way, the differential pressure between the first air chamber 44 and the second air chamber 45 can be decreased rapidly. In addition, even when the first valve body 34 has engaged with the engaging portion 35*f* by moving by the predetermined distance after it is opened, the first air chamber 44 and the second air chamber 45 remain in communication with each other. Therefore, the second valve body 35 can be opened more reliably.

The embodiments of the present invention described above are merely illustration of some application examples of the present invention and not of the nature to limit the technical scope of the present invention to the specific constructions of the above embodiments.

Figure 7:
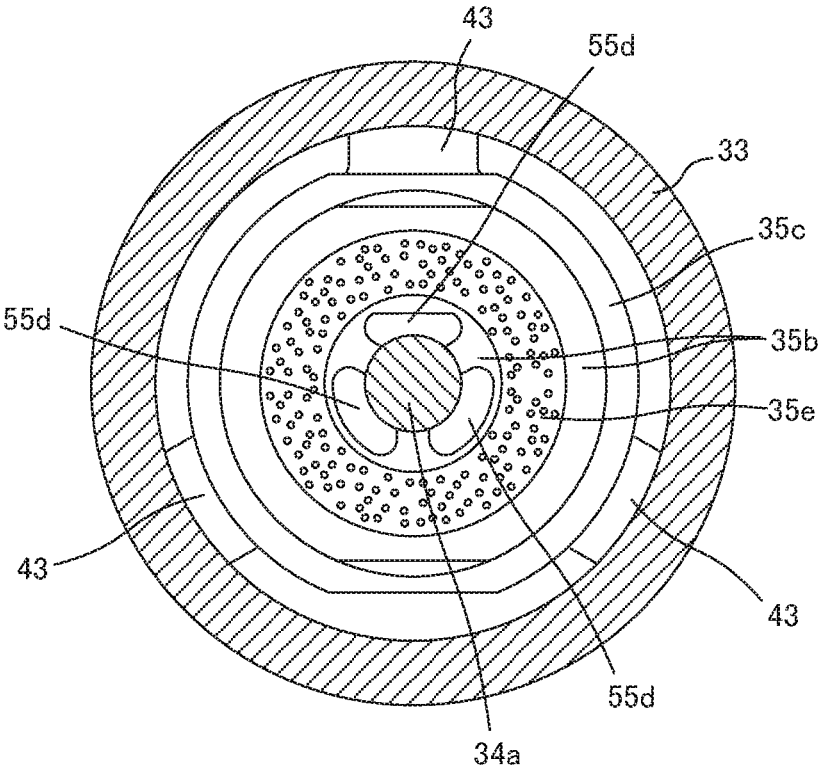
FIG. 7 is a cross-sectional view showing a modification example of the second valve body.

For example, while the connection passage 35*d* having a semicircular shape in cross section is formed in the above-described embodiment as shown in FIG. 4A, a connection passage 55*d* having an elliptical shape may be formed as shown in FIG. 7. By increasing a cross-sectional area of the connection passage 55*d*, the differential pressure between the first air chamber 44 and the second air chamber 45 can be decreased more rapidly when the first valve body 34 is opened.

Furthermore, while the above-described embodiment has presented an exemplary case in which each of the air supply valve 31 and the air discharge valve 32 includes the first valve body 34 and the second valve body 35, it is possible to adopt a configuration in which only one of the air supply valve 31 and the air discharge valve 32 includes the first valve body 34 and the second valve body 35, and the other includes only a single valve body.

The invention claimed is:

1. A leveling valve configured to adjust a height of an air spring provided between a vehicle body and a truck of a railway vehicle, the leveling valve comprising:

a lever configured to rotate in accordance with a relative displacement of the vehicle body with respect to the truck;

an actuator arm configured to rotate due to a restoring force of a buffer spring that deforms in accordance with rotation of the lever; and a connecting valve configured to be opened by rotation of the actuator arm against air pressure, and connect a compressed air source or an air discharge passage to an air spring passage communicating with the air spring, the connecting valve comprising:

a first valve body configured to move in a valve-opening direction by being pressed by the actuator arm in accordance with rotation of the actuator arm;

a second valve body configured to include a first valve seat from/on which the first valve body is separated/seated;

a sleeve inside which the first valve body and the second valve body are slidably arranged, the sleeve including an annular second valve seat from/on which the second valve body is separated/seated; and an engaging portion provided to the second valve body, the engaging portion being configured to engage with the first valve body and move the second valve body in the valve-opening direction together with the first valve body when the first valve body has moved by a predetermined distance after the first valve body is opened, wherein a pressure receiving area of the second valve body is larger than a pressure receiving area of the first valve body.

2. The leveling valve according to claim 1, wherein the second valve seat is raised from the sleeve in the valve-opening direction, and a flow passage is present between an inner circumference of the sleeve and an outer circumference of the second valve body.

3. The leveling valve according to claim 1, wherein the second valve body further includes a through-hole that is formed between the first valve seat and the engaging portion and radially penetrates the second valve body.

4. The leveling valve according to claim 1, wherein the connecting valve is composed of an air supply valve and an air discharge valve, the air supply valve being configured to connect the compressed air source to the air spring passage by being opened due to rotation of the actuator arm from a neutral position in one direction by a predetermined degree or more, and the air discharge valve being configured to connect the air discharge passage to the air spring passage by being opened due to rotation of the actuator arm from the neutral position in the other direction by the predetermined degree or more.

* * * * *